US010695828B2

(12) United States Patent
Du et al.

(10) Patent No.: US 10,695,828 B2
(45) Date of Patent: Jun. 30, 2020

(54) CONTINUOUS CASTING AND CONTINUOUS FORGING FORMING PROCESS FOR ALUMINUM WHEEL

(71) Applicant: CITIC Dicastal CO., LTD, Qinhuangdao (CN)

(72) Inventors: Dexi Du, Qinhuangdao (CN); Zhihua Zhu, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 0 days.

(21) Appl. No.: 16/058,267

(22) Filed: Aug. 8, 2018

(65) Prior Publication Data

US 2019/0283123 A1 Sep. 19, 2019

(30) Foreign Application Priority Data

Mar. 13, 2018 (CN) ..... 2018 1 0204231

(51) Int. Cl.

| | |
|---|---|
| ***B22D 18/02*** | (2006.01) |
| ***B22D 18/04*** | (2006.01) |
| ***B22C 9/28*** | (2006.01) |
| ***B22D 17/00*** | (2006.01) |

(52) U.S. Cl.

CPC ..... *B22D 18/04* (2013.01); *B22C 9/28* (2013.01); *B22D 17/002* (2013.01); *B22D 18/02* (2013.01)

(58) Field of Classification Search

CPC ..... B22D 18/02; B22D 18/04
USPC ..... 164/900
See application file for complete search history.

(56) References Cited

U.S. PATENT DOCUMENTS

| | | | | |
|---|---|---|---|---|
| 5,900,080 | A | 5/1999 | Baldi et al. | |
| 2005/0056394 | A1* | 3/2005 | Kamm | B22D 17/007 164/113 |
| 2018/0354176 | A1* | 12/2018 | Yang | B29C 45/4005 |

FOREIGN PATENT DOCUMENTS

| | | | | |
|---|---|---|---|---|
| CN | 201871710 | U | 6/2011 | |
| CN | 202097389 | U | 1/2012 | |
| CN | 204584228 | U | 8/2015 | |
| DE | 19533447 | C1 | 12/1996 | |
| DE | 102016106256 | B3 | 3/2017 | |
| EP | 3170582 | A1 | 5/2017 | |
| WO | WO-2009072222 | A1 * | 6/2009 | B22D 17/007 |
| WO | 2017013590 | A1 | 1/2017 | |

* cited by examiner

*Primary Examiner* — Kevin E Yoon
(74) *Attorney, Agent, or Firm* — Calfee, Halter & Griswold LLP

(57) ABSTRACT

Disclosed is a continuous casting and continuous forging forming process for an aluminum wheel. The process combines the advantage of low-pressure filling stability of molten aluminum alloy, and utilizes the strengthening effect of extrusion deformation forging of a side mold locking ring and a pressure module to improve the mechanical properties of an aluminum wheel material to close to the forging level. A mold cavity is sealed by means of the side mold locking ring and a center mold locking taper, and the extrusion forging pressure acts on the surface of the aluminum alloy in the closed mold cavity, so that the requirement of equipment for mold closing tonnage is lowered, and the cost of the equipment is far lower than that of forging equipment and equivalent to that of casting equipment.

6 Claims, 4 Drawing Sheets

CONTINUOUS CASTING AND CONTINUOUS FORGING FORMING PROCESS FOR ALUMINUM WHEEL

CROSS-REFERENCE TO RELATED APPLICATIONS

This application claims priority to Chinese Patent Application No. 201810204231.2 filed on Mar. 13, 2018, which is hereby incorporated by reference in its entirety.

TECHNICAL FIELD

The present application relates to an aluminum wheel forming process.

BACKGROUND ART

Wheels are important safety parts of an automobile driving system, and the requirement for the mechanical properties of the material thereof is usually strict. In addition, the weight reduction of the automotive industry requires the more use of aluminum alloy as a substitute of steel in the materials for wheels. The mainstream manufacturing processes for aluminum wheels include a low-pressure casting process for cast aluminum alloy wheels and a forging process for wrought aluminum alloy wheels.

The low-pressure casting indicates that molten aluminum alloy in a holding furnace is pressed into a mold cavity through dry compressed air, and then the molten aluminum alloy is transformed into a casting by creating a sequential solidification condition under certain pressure. Its characteristic is that the holding pressure is generally not more than a standard atmospheric pressure, whereas the yield strength of the spokes of the cast aluminum wheel is usually about 200 MPa and the elongation is 7%.

The forging indicates that wrought aluminum alloy bars are subjected to a solid-state forming technology of forging, spinning or the like, and it has the characteristics that the press tonnage and the equipment investment are high, the mechanical properties of the material for the forged aluminum wheel are more excellent, the yield strength of the spokes of the forged aluminum wheel is usually about 300 MPa and the elongation is 10%.

SUMMARY OF THE INVENTION

Based on the above background, the technical problem to be solved by the present application is to overcome low holding pressure for low-pressure casting, improve the mechanical properties of a casting material to close to the forging level, and maintain the cost level of the low-pressure casting process.

The technical solution adopted by the present application is: a continuous casting and continuous forging forming process for an aluminum wheel includes the steps of feeding molten aluminum alloy into a mold assembly until the mold cavity is full, and holding a low pressure for a period of time, the mold assembly comprises a top mold, side molds and a bottom mold; lowering a side mold locking ring and a center mold locking taper to completely seal the molten aluminum alloy in the mold cavity, removing the low pressure in a holding furnace, opening forced water cooling on two sides of corresponding spokes of top mold and bottom mold, and after the temperatures of the top mold and the bottom mold are in a liquid-solid coexistence state of the aluminum alloy, lowering a top pressure module to implement extrusion deformation strengthening, until the molten aluminum alloy is completely crystallized and solidified; and opening the mold assembly to take the casting out.

In order to rapidly switch the casting process and the forging process and improve the material structure properties of the product, when the mold cavity is full of the molten aluminum alloy, a thermocouple placed on the top mold can simultaneously detect a rapid temperature rise and transmit this signal to an industrial control computer (IPC) of equipment, the IPC issues an instruction, and the side mold locking ring is lowered to extrude four side molds.

The side mold locking ring is fitted with the four side molds through an oblique tapered surface with a tapered angle of 10° to 15°.

The center mold locking taper is fitted with a center sprue through an oblique tapered surface with a tapered angle of 0° to 5°.

The temperatures of the top mold and the bottom mold in the liquid-solid coexistence state of the aluminum alloy are 570° C. to 610° C.

The lowering speed of the top pressure module can be divided into first low-speed pressurization and then high-speed pressurization. The advancing speed of the low-speed pressurization stage is set to 0 to 0.2 mm/s. The advancing speed of the high-speed pressurization stage is set to 0.5 to 0.8 mm/s.

In the aluminum alloy wheel manufactured by the continuous casting and continuous forging forming process according to the present application, the rim is strengthened by extrusion deformation, the spokes are strengthened by forging extrusion of the pressure module, and the strength and the toughness of the obtained casting are close to a pure forging process level on the whole. The side mold locking ring and the center mold locking taper are used in the present application to completely seal the aluminum alloy in the closed mold cavity, and the forging extrusion force of the pressure module will completely act on the interior of the mold cavity, so that the tonnage limits of equipment mold clamping force and the like are not involved, that is, when an aluminum wheel casting having material mechanical properties close to those of the forging process is obtained, the equipment investment is equivalent to that of the casting process and far lower than the cost of forging equipment.

BRIEF DESCRIPTION OF DRAWINGS

The present application will be further illustrated below in conjunction with the drawings and embodiments.

DETAILED DESCRIPTION OF THE INVENTION

Figure 1:
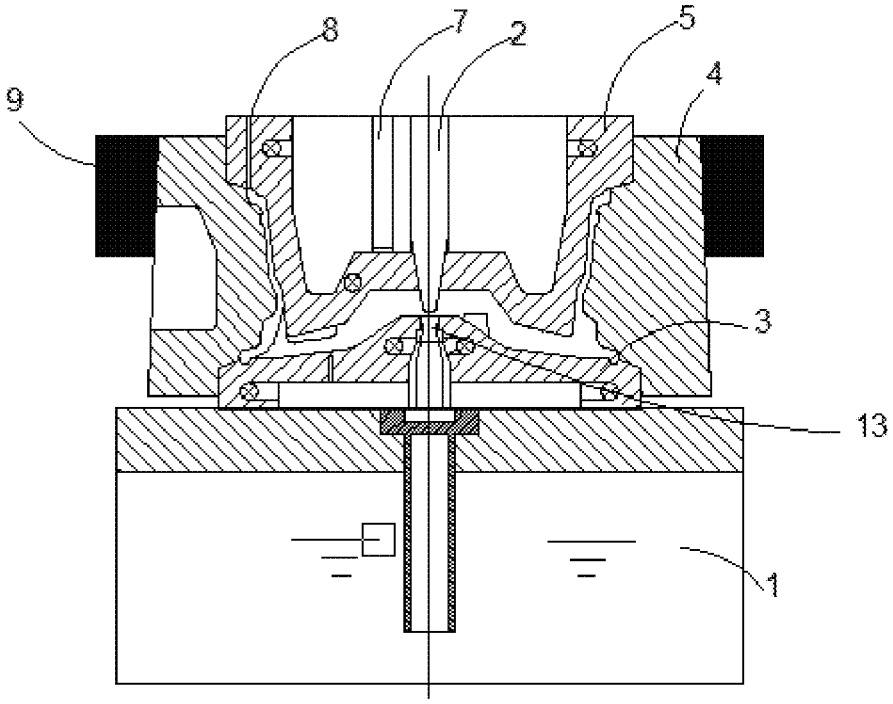
FIG. 1 is a schematic diagram of a continuous casting and continuous forging forming process device for an aluminum wheel according to the present application.
Figure 2:
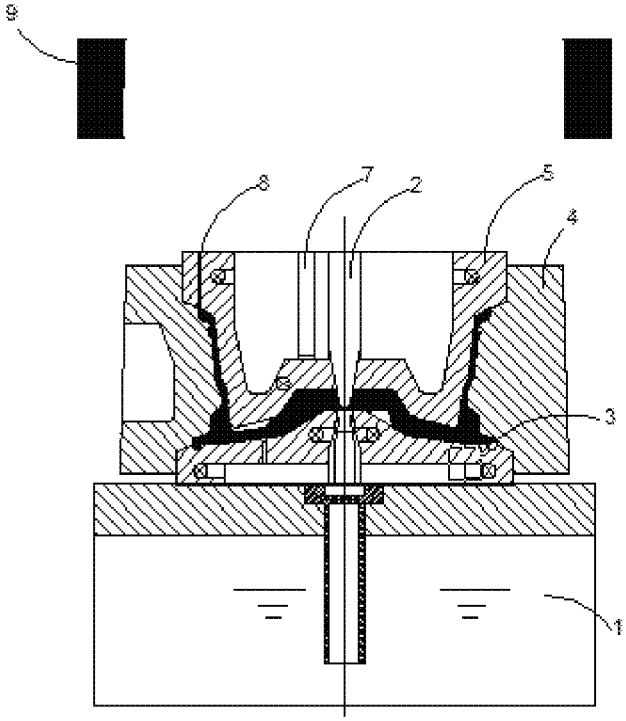
FIG. 2 is a schematic diagram of a casting stage at which the mold cavity is full of molten aluminum alloy.
Figure 3:
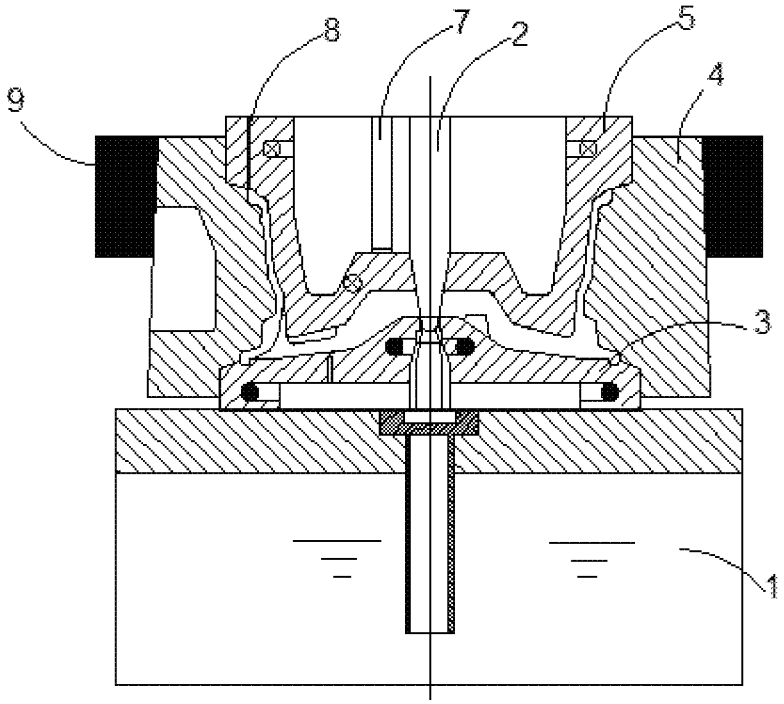
FIG. 3 is a schematic diagram of a cooling stage at which a side mold locking ring and a center mold locking taper are lowered and mold water cooling is started.
Figure 4:
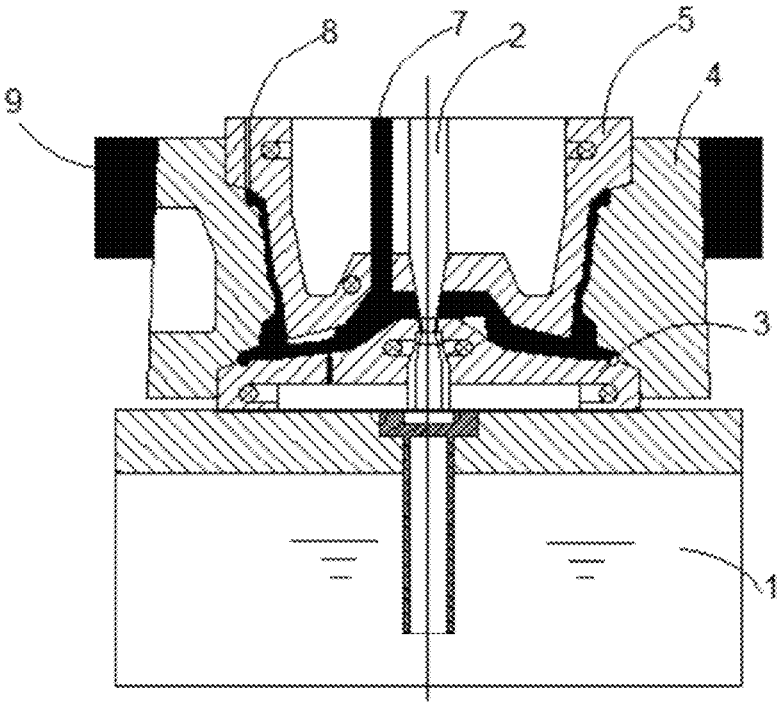
FIG. 4 is a schematic diagram of a stage from lowering of a pressure module to crystallization and solidification of aluminum alloy.

The details and working conditions of the specific device proposed by the present application will be described below in combination with the accompanying drawings.

A continuous casting and continuous forging forming process for an aluminum wheel includes the steps of feeding molten aluminum alloy into a mold assembly until the mold cavity is full, and holding a low pressure for a period of time; lowering a side mold locking ring 9 and a center mold locking taper 2 to completely seal the molten aluminum alloy in the mold cavity, removing the low pressure in a holding furnace 1, opening forced water cooling on two sides of corresponding spokes of top mold 5 and bottom mold 3, and after the temperatures of the top mold and the bottom mold are in a liquid-solid coexistence state of the molten aluminum alloy, lowering a top pressure module 7 to implement extrusion deformation strengthening, until the molten aluminum alloy is completely crystallized and solidified; and opening the mold assembly to take the casting out.

In order to rapidly switch the casting process and the forging process and improve the material structure properties of the product, when the mold cavity is full of the molten aluminum alloy, a thermocouple 8 placed on the top mold can simultaneously detect a rapid temperature rise and transmit this signal to an industrial control computer (IPC) of equipment, an instruction is issued, and the side mold locking ring 9 is lowered to extrude four side molds 4.

The side mold locking ring is fitted with the four side molds through an oblique tapered surface with a tapered angle of 12° to 15°.

The center mold locking taper 2 is fitted with a center sprue 13 through an oblique tapered surface with a tapered angle of 0.5° to 5°.

The temperatures of the top mold and the bottom mold in the liquid-solid coexistence state of the aluminum alloy are 600° C. to 610° C.

The lowering speed of the top pressure module can be divided into first low-speed pressurization and then high-speed pressurization. The advancing speed of the low-speed pressurization stage is set to 0.1 to 0.2 mm/s. The advancing speed of the high-speed pressurization stage is set to 0.5 to 0.7 mm/s.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous casting and continuous forging forming process for an aluminum wheel, comprising low-pressure filling and extrusion forging, wherein the process comprises feeding molten aluminum alloy into a mold assembly until a mold cavity is full, and holding a low pressure for a period of time; lowering a side mold locking ring and a center mold locking taper to completely seal the molten aluminum alloy in the mold cavity, removing the low pressure in a holding furnace, opening forced water cooling on two sides of corresponding spokes of top mold and bottom mold, and after a temperatures of the top mold and the bottom mold are in a liquid-solid coexistence state of the molten aluminum alloy, lowering a top pressure module to implement extrusion deformation strengthening, until the molten aluminum alloy is completely crystallized and solidified; and opening the mold assembly to take the casting out;

the side mold locking ring is fitted with the four side molds through an oblique tapered surface with a tapered angle of 10° to 15°, the center mold locking taper is fitted with a center sprue through an oblique tapered surface with a tapered angle of 0° to 5°, the temperatures of the top mold and the bottom mold in the liquid-solid coexistence state of the aluminum alloy are 570° C. to 610° C., a lowering speed of the top pressure module is configured to be divided into first low-speed pressurization and then high-speed pressurization, the advancing speed of the low-speed pressurization stage is set to 0 to 0.2 mm/s, and the advancing speed of the high-speed pressurization stage is set to 0.5 to 0.8 mm/s.

2. The continuous casting and continuous forging forming process for an aluminum wheel according to claim 1, wherein the side mold locking ring is fitted with the four side molds through an oblique tapered surface with a tapered angle of 12° to 15°.

3. The continuous casting and continuous forging forming process for an aluminum wheel according to claim 1, wherein the center mold locking taper is fitted with a center sprue through an oblique tapered surface with a tapered angle of 0.5° to 5°.

4. The continuous casting and continuous forging forming process for an aluminum wheel according to claim 1, wherein the temperatures of the top mold and the bottom mold in the liquid-solid coexistence state of the aluminum alloy are 600° C. to 610° C.

5. The continuous casting and continuous forging forming process for an aluminum wheel according to claim 1, wherein the advancing speed of the low-speed pressurization stage of lowering the pressure block is set to 0.1 to 0.2 mm/s.

6. The continuous casting and continuous forging forming process for an aluminum wheel according to claim 1, wherein the advancing speed of the high-speed pressurization stage of lowering the pressure block is set to 0.5 to 0.7 mm/s.

* * * * *